US006361346B1

(12) United States Patent
Matsuoka

(10) Patent No.: US 6,361,346 B1
(45) Date of Patent: Mar. 26, 2002

(54) CONNECTOR SYSTEM

(75) Inventor: Hiroyuki Matsuoka, Sagamihara (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/630,213

(22) Filed: Aug. 1, 2000

(30) Foreign Application Priority Data

Sep. 14, 1999 (JP) ..... 11-260623

(51) Int. Cl.[7] ..... H01R 13/627
(52) U.S. Cl. ..... 439/352; 439/607
(58) Field of Search ..... 439/352, 350, 439/351, 353, 354, 355, 357, 358, 607, 609, 610, 701

(56) References Cited

U.S. PATENT DOCUMENTS

| | | | | |
|---|---|---|---|---|
| 4,787,860 A | | 11/1988 | Bender | 439/358 |
| 5,171,161 A | * | 12/1992 | Kachlic | 439/352 |
| 5,779,495 A | * | 7/1998 | Dechelette et al. | 439/353 |

FOREIGN PATENT DOCUMENTS

| | | |
|---|---|---|
| EP | 0 512 438 A2 | 11/1992 |
| JP | 7-320816 | 12/1995 |
| JP | 10-83697 | 3/1998 |
| JP | 10-162884 | 6/1998 |
| JP | 10-189150 | 7/1998 |

OTHER PUBLICATIONS

Search Report for PCT/US00/21251.

* cited by examiner

*Primary Examiner*—Gary Paumen
*Assistant Examiner*—Ross Gushi
(74) *Attorney, Agent, or Firm*—Yen Tong Florczak

(57) ABSTRACT

An electrical connector system having contacts arranged in rows and lines, wherein the system is constituted by a board-side connector adapted to be connected to a printed board and a harness connector adapted to be connected to an electric cable, and comprising a latch means for releasably fixing the board-side connector and the harness connector to each other, the latch means being installed within the outermost profile of both the connectors. A latch mechanism for fixing a grounding mechanism between female and male connectors or the female and male connectors is installed within the outermost profile of the connector system.

7 Claims, 6 Drawing Sheets

CONNECTOR SYSTEM

BACKGROUND OF THE INVENTION

The present invention relates to an electrical connector system of a female-male coupling type which is adapted to be used in a switch-board or transmission equipment, and more particularly to a metric connector system which is adapted to be used for signal lines arranged in rows and lines and needing to be electromagnetically shielded from one another and is provided with sufficient countermeasures against external stress load such as vibrations.

Conventionally, connectors for use in switch-board or transmission equipment, for example, connectors which enable a high-density connection by reducing the interval (pitch) between a plurality of contacts, have been proposed to meet demands for high-density signal lines. For example, disclosed in a magazine called the "Computer Design" (FIG. 8 on page 55, issued in July, 1991, by Denpa Shimbun-Sha (Electric Wave Newspaper Inc.) is a female connector comprising a plurality of contacts arranged at 2 mm pitches in a square lattice-like fashion which is based on the P1301.1 standard of IEEE Standards and the IS-64 standard of EIA Standards. This female connector is, for example, a connector of a type allowing a plurality of such female connectors to be disposed adjacent to one another at desired positions relative to a number of male-type contacts arranged at identical pitches on a board so that female-type contacts are connected to the male-type contacts without any waste of time.

Japanese Unexamined Patent Publication (Kokai) No. 10-162884 discloses a connector system having female connectors intended to be disposed adjacently as described in the aforesaid magazine. The connector of the connector system disclosed therein comprises contacts arranged in a square lattice-like fashion for connection with an electric cable. Similarly, Japanese Unexamined Patent Publication (Kokai) No. 10-189150 also discloses a connector system in which female connectors are disposed adjacent to one another and the female connectors each comprise contacts arranged in a square lattice-like fashion. The connector system disclosed therein comprises a metal shell for electromagnetic shielding.

In addition, Japanese Unexamined Patent Publication (Kokai) No. 10-83867 also discloses a connector system having a female connector intended to be disposed adjacently. The connector system disclosed therein comprises a female connector and a male connector, which are constructed so as to be releasably fixed to each other with a latch means. Moreover, Japanese Unexamined Patent Publication (Kokai) No. 7-320816 also discloses a connector system having female connectors intended to be disposed adjacent each other. The outermost profile of the connector of the connector system disclosed therein has an irregular shape, not a square shape.

The aforesaid conventional connector systems comprising signal lines arranged in rows and lines in a square lattice-like fashion has the following problems. Any of the aforesaid connector systems does not satisfy both the electromagnetic shielding countermeasures and the releasable fixation of the connectors when they are coupled together. In the above connector systems, in a case where while taking the electromagnetic shielding countermeasures, the connectors are tried to be releasably fixed to each other, the size of the outermost circumference of the connector system unexpectedly becomes large.

In addition, in the above connector system disclosed in Japanese Unexamined Patent Publication (Kokai) No. 7-320816, since the outermost profile of the connector is an irregular shape, although it can be arranged in one direction, the connector system cannot be arranged in rows and lines in a square lattice-like fashion. In other words, the installing density is relatively low.

The present invention was made in view of these problems, and an object thereof is to provide a connector system in which a grounding mechanism between female and male connectors and a latch mechanism for fixing female and male connectors to each other are housed within the outermost profile of the connector system.

In addition, another object of the present invention is to provide a connector system which has superior electromagnetic shielding properties and coupling fixation properties between female and male connectors.

Moreover, a further object of the present invention is to provide a connector system in which contacts in one of the connectors are arranged in rows and lines in a square lattice-like fashion and in which even in a case where the connectors are arranged in rows and lines, the contacts are, as a whole, arranged in the square lattice-like fashion.

SUMMARY OF THE INVENTION

With a view to attaining the above objects, according to the present invention, there is provided a connector system having contacts arranged in rows and lines, wherein the system is constituted by a board-side connector adapted to be connected to a printed board and a harness connector adapted to be connected to an electric cable, and comprising latch means for releasably fixing the board-side connector and the harness connector to each other, the latch means being installed within the outermost profile of both the connectors. Consequently, both the connectors are releasably fixed to each other with the latch means installed within the outermost profile formed by the board-side connector and the harness connector.

According to the prevent invention, there is also provided a connector system, wherein each of the connectors respectively comprises a set of complementary shield shells.

According to the present invention, furthermore, there is provided a connector system, wherein the harness connector is constituted by assembling sequentially from an interior side to an exterior side thereof a first insulated resin molding into which the contacts are inserted, a second insulated resin molding on which a latch arm of the latch means is mounted, a cable-side metal shell for electromagnetic shielding and a third insulated resin molding for protection against static electricity.

Moreover, according to the present invention, there is provided a connector system, wherein the board-side connector is of a module type and has a board-side metal shell which has a pin or pins for grounding the printed board on at least one of outer sides of the board-side connector.

In addition, according to the present invention, there is provided a connector system, wherein the cable-side metal shell and the board-side metal shell each comprises a complementary contacting structure and these complementary contacting structures are brought into contact with each other when the harness connector is connected to the board-side connector.

Furthermore, according to the present invention, there is provided a connector system, wherein the board-side connector is of a modular type and has a shielding plate, the cable-side metal shell has a spring-type connecting structure, and the contacting structure is adapted to be brought into contact with the plate when the harness connector is connected to the board-side connector.

Moreover, according to the present invention, there is provided a connector system, wherein the latch means is of an inner-latch type adapted to operate only within the outermost profile of both connectors.

Furthermore, according to the present invention, there is provided a connector system, wherein the system comprises polarized keys for preventing an erroneous connection between the harness connector and the board-side connector.

DETAILED DESCRIPTION OF THE INVENTION

Figure 1:
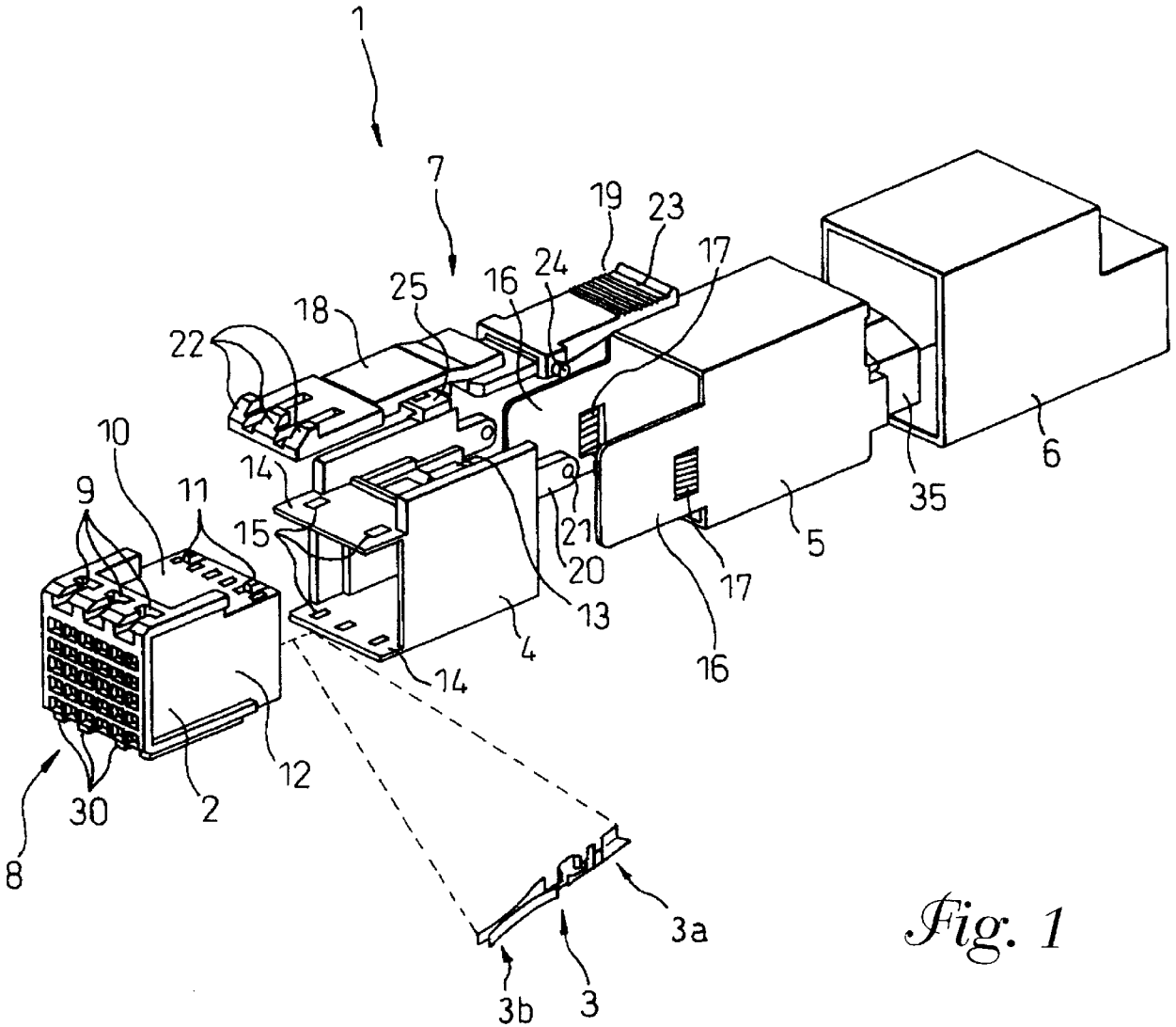
FIG. 1 is an exploded perspective view of a harness connector according to the present invention.

Referring to the accompanying drawings, a preferred embodiment of the present invention will be described in detail below. A connector system according to the present invention comprises in general a board-side connector adapted to be connected to a printed board and a harness connector adapted to be connected to an electric cable. First, the harness connector will be described. In the following descriptions, "upper" and "lower" are to denote "upper" and "lower" as viewed in the drawings, respectively, and "front" and "rear" are to denote a board side and a cable side, respectively, in a state in which the board-side connector and the harness are coupled together.

Referring to FIG. 1, a harness connector 1 according to the embodiment is shown therein. The harness connector 1 is a cable-side connector adapted to be connected to an electric cable. In general, the harness connector 1 comprises a first molding 2, a plurality of cable-side contacts 3, a second molding 4, a cable-side shell 5, a third molding 6 and a latch mechanism 7. In FIG. 1, for the sake of clear understanding, only a single cable-side contact 3 is illustrated in an enlarged fashion.

The first molding 2 is made of industrial plastics (for example, an insulated resin such as PBT, PCT, nylon, LCP) and has a substantially square cross-sectional configuration. A plurality of inserting holes 8 are formed in a front wall of the first molding 2. These inserting holes 8 are formed in rows and lines at 2 mm pitches in a square lattice-like fashion. Inserted into the inserting holes 8 are board-side contacts (which will be described later) adapted to be connected to a printed board. In addition, a space is formed in the interior of the first molding 2. The cable-side contacts 3 are disposed within in the interior space in the first molding 2 in such a manner as to be in alignment with the inserting holes 8, respectively.

Three guide grooves 9 are formed in a front area on an upper side of the first molding 2. On the other hand, three guide projections 30 are formed at a front area on a lower side of the first molding 2. These guide grooves 9 and the guide projections 30 function to prevent the erroneous insertion of the harness connector 1 when the harness connector 1 is coupled to the board-side connector.

Two projections 11 are formed at a rear area on the upper side thereof. On the other hand, three projections (not shown) are provided at a rear area on the lower side of the first molding 2. These projections 11 engage in openings (which will be described) formed in the second molding 4 to thereby fix the second molding 4 to the first molding 2.

In addition, a recessed portion 10 is formed in the upper side of the first molding 2 from a central area to the rear area. The recessed portion 10 receives a latch member (which will be described later) of the latch mechanism 7 when the latch mechanism 7 is mounted on the second molding 4.

Furthermore, recessed portions 12 are formed in both sides of the first molding 2 in such a manner as to extend over the whole area thereof. The recessed portions 12 are adapted to receive projecting plates (which will be described later) of the cable-side shell 5 when the cable-side shell 5 is assembled to the first molding 2 and the second molding 4.

The cable-side contacts 3 are made of a copper alloy for springs and gold plated at portions thereof which are designed for electric connection. The cable-side contacts 3 are each of a type having a pair of cantilevers facing each other at ends thereof. Board-side contacts 3 are inserted between the cantilevers, whereby the board-side contacts and the cable-side contacts are electrically connected to each other. In addition, the cable-side contacts 3 each have at ends thereof, respectively, a connecting portion 3*a* adapted to be in contact with an electric cable and a connecting portion 3*b* adapted to be in contact with board-side contacts.

The second molding 4 is made from industrial plastics and has a box-like configuration. A recessed portion 13 is formed in an upper side of the second molding 4. The recessed portion 13 receives the latch mechanism 7 when the latch mechanism 7 is mounted on the second molding 4 such that the latch mechanism 7 operates only within the outermost profile of the harness connector 1. A pair of grooves (not shown) are formed in the upper side of the second molding 4. Hook members (which will be described later) of a latch member of the latch mechanism 7 are brought into engagement with these grooves.

Furthermore, the second molding 4 has a pair of projecting plates 14 extending forward from the upper and lower sides thereof. Openings 15 are formed in these projecting plates 14 in such a manner as to face the projections 11 on the first molding 2. These openings 15 are adapted to be brought into engagement with the projections 11 when the second molding 4 is assembled to the first molding 2, whereby the second molding 14 is mounted on the first molding 2.

In addition, the second molding 4 has a pair of projections 20 extending rearward from the upper and lower sides thereof. Openings 21 are formed in the projections 20. Pivot shafts (which will be described later) of the latch lever of the latch mechanism 7 are inserted into the openings 21.

The latch mechanism 7 comprises two components, i.e., the latch member and the latch lever 19. These latch member 18 and the latch lever 19 are made from an industrial plastics. The latch member 18 has three latches 22 in a front area thereof. These latches 22 come into engagement with openings (which will be illustrated later) facing the board-side connector when the harness connector 1 is coupled to the board-side connector, whereby the harness connector 1 is releasably fixed to the board-side connector. In addition, the latch member 18 has a pair of hook members 25 on both sides of the central area thereof. These hook members 25 come into engagement with grooves (not shown) formed in the upper side of the second molding 4 when the latch mechanism 7 is assembled to the second molding 4. On the other hand, the latch lever 19 has the pivot shafts 24 formed at central areas on both sides thereof. These pivot shafts 24 are pivotably inserted into the openings 21 when the latch mechanism 7 is assembled to the second molding 4. The latch lever 19 has a manipulating part 23 at the rear area.

Figure 3A:
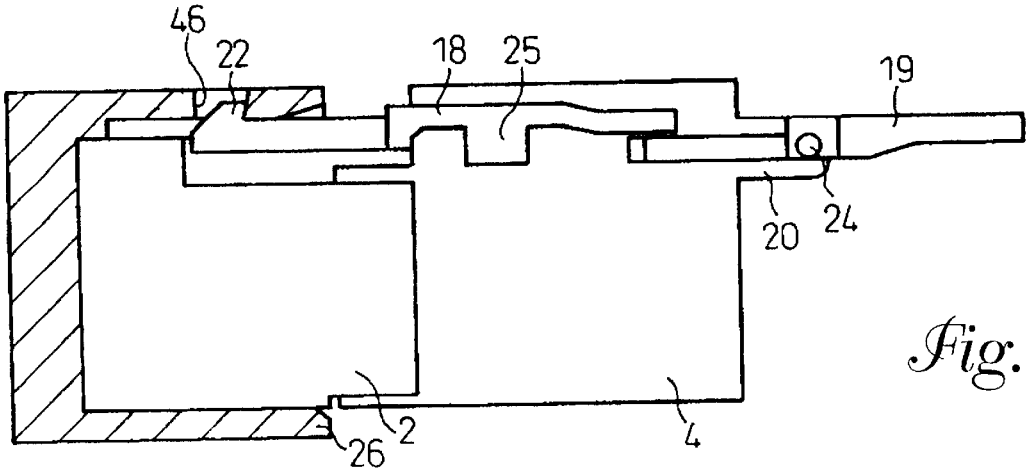
FIG. 3A is a partial sectional view showing the harness connector fixed with a latch mechanism.
Figure 3B:
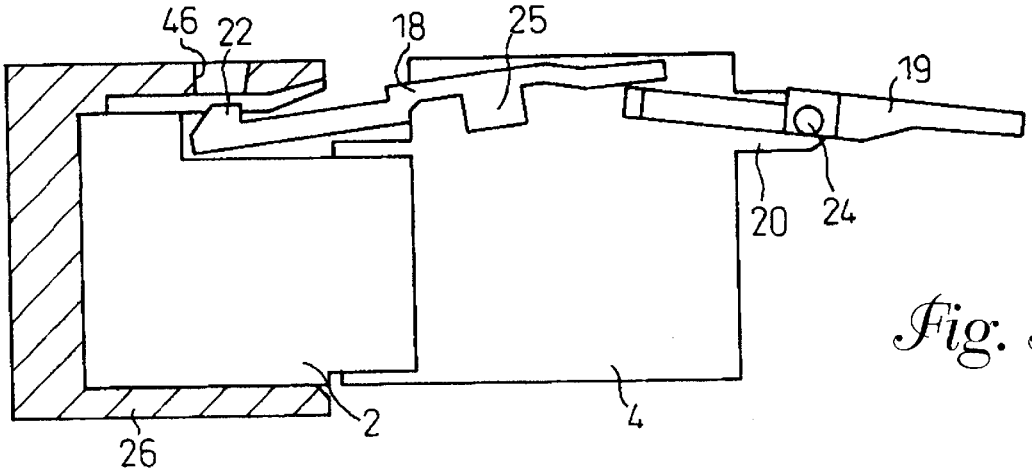
FIG. 3B is a partial sectional view showing the harness connector when the latch mechanism is released.

As shown in FIG. 3A, the lower side of the rear area of the latch member 22 rides on the upper side of the front area of the latch lever 19 when the latch mechanism 7 is assembled to the second molding 4. In addition, when this happens, the latch member 18 and the latch lever 19 are pivotably mounted on the second molding 4, respectively. Thus, when the manipulating portion 23 of the latch lever 19 is pressed downwardly toward the second molding 4, as shown in FIG. 3B, the front area of the latch lever 19 moves upwardly so as to move away from the second molding 4 about the pivot shafts 24 functioning as a fulcrum. Then, the rear area of the latch member 18 moves upwardly so as to move away from the second molding 4 about the hook members 25 functioning as a fulcrum in conjunction with the upward movement of the front area of the latch lever 19. Then, the front area of the latch member 18 moves downwardly toward the second molding 4 about the hook members 25 functioning as a fulcrum in conjunction with the movement of the rear area of the latch member 18. Consequently, the latches 22 of the latch mechanism 7 dislocate from the openings 46 facing the latches 22 in the board-side connector, whereby the harness connector 1 dislocates from the board-side connector 26.

Thus, the latch mechanism 7 according to the present invention is of an inner latch type in which the latch operates toward the harness connector. According to this, the latch mechanism operates only within the outermost profile of the harness connector.

The cable-side shell 5 is made from a copper alloy and has a box-like configuration. The cable-side shell 5 is a component for use for electromagnetic shielding. The cable-side shell 5 has a pair of projecting plates 16 extending from the sides forwardly. These projecting plates 16 are received in the recessed portions 12 formed in the first molding 2 when the cable-side shell 5 is assembled to an assembly comprising the first molding 2, the second molding 4 and the latch mechanism 7. In addition, when this takes place, in general, the cable-side shell 5 covers the first molding 2, the second molding 4 and the latch mechanism 7. Thus, as is described above, when the latch mechanism 7 operates only within the outermost profile of the harness connector 1, or, in particular, the cable-side shell 5.

The cable-side shell 5 has a cable-side contacting structure 17 on each projecting plates 16. In this case, the structure is shown as comprising an elastic body, and the cable-side contacting structure 17 is formed by cutting a portion of the material of the projecting plate 16 and raising the material so cut. The cable-side contacting structure 17 is a conducting means for grounding. In addition, the cable-side shell 5 has a cable clamping portion 35 at a rear area thereof. The cable clamping portion 35 is clamped around the electric cable so as to hold the same.

Figure 2:
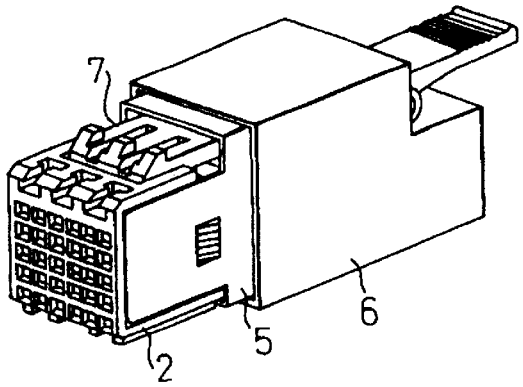
FIG. 2 is an assembled perspective view of the harness connector according to the present invention.

The third molding 6 is made of industrial plastics and has a box-like configuration. The third molding 6 is a component for use as countermeasures against static electricity. As shown in FIG. 2, in general, the third molding 6 surrounds the second molding 4, the latch mechanism 7 and the cable-side shell 5 when the third molding 6 is assembled to an assembly comprising the first molding 2, the second molding 4, the latch mechanism 7 and the cable-side shell 5.

Thus, in this embodiment, the first molding 2, the second molding 4, the cable-side shell 5 and the third molding 6 are assembled from the interior to the exterior or from the inside to the outside.

Figure 4:
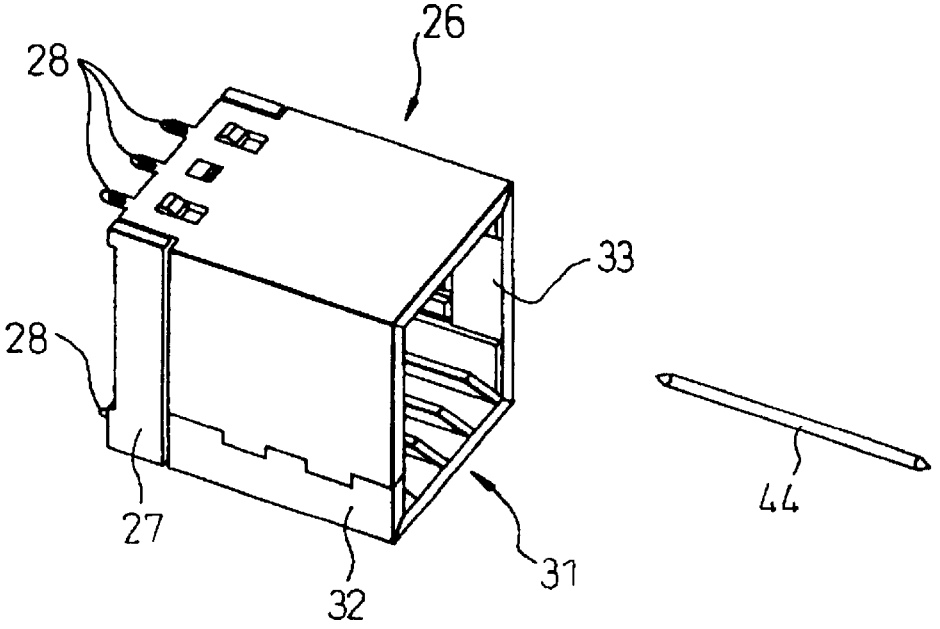
FIG. 4 is an assembled perspective view of a board-side connector according to the present invention.

Next, the board-side connector will be described. A board-side connector according to the present invention is shown in FIG. 4. The board-side connector 26 comprises a fourth molding 27, a board-side shell 32 and board-side contacts 44.

The fourth molding 27 is made from industrial plastics and has a box-like configuration. Formed on inner wall surfaces of the fourth molding 27 are guide projections (not shown) corresponding to the guide grooves 9 of the first molding and guide grooves 31 corresponding to the guide projections 30 of the first molding 2. The guide projections are inserted into the guide grooves 9 corresponding thereto of the first molding 2 when the harness connector 1 is inserted into the board-side connector 26. In addition, the guide grooves 31 receive therein the guide projection corresponding 30 thereto of the first molding 2 when the harness connector 1 is inserted into the board-side connector 26. This construction prevents the erroneous insertion of the harness connector 1 into the board-side connector 26.

In addition, a plurality of inserting holes (not shown) are formed in a wall of the fourth molding 27 on a board side thereof. These inserting holes are disposed in rows and lines at 2 mm pitches in a square lattice-fashion. The board-side contacts 44 are inserted into these inserting holes for connection to the printed board.

Furthermore, openings 46 are formed in the fourth molding 27 in such a manner as to correspond to the latches 22 of the latch mechanism 7 (refer to FIG. 3). The latches 22 of the latch mechanism 7 are brought into engagement with the openings 46 when the harness connector 1 is coupled to the board-side connector 26, whereby the harness connector 1 is releasably fixed to the board-side connector 26.

Figure 5:
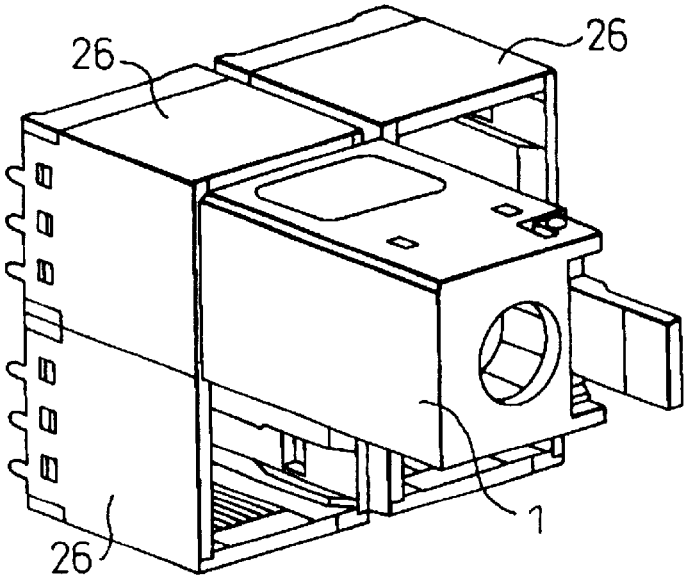
FIG. 5 is a perspective view of a connector system according to the present invention.

The board-side shell 32 is made from a copper alloy and has a box-like configuration. The board-side shell 32 is a component for use for electromagnetic shielding. The board-side shell 32 is mounted on the fourth molding 27 in such a manner as to cover the same. Consequently, the board-side connector 26 has a box-like configuration as a whole. Due to this, as shown in FIG. 5, the board-side connector 26 can be disposed on the printed board in rows and lines in a square lattice-fashion. According to this construction, the installing density of the board-side connector can extremely be improved In addition, the board-side shell 32 has a plurality of pins 28 extending to the front from upper and lower sides thereof. These pins 28 are inserted into holes corresponding thereto of the printed board when the board-side connector 26 is connected to the printed board, whereby the board-side connector 26 is fixed to the printed board.

Moreover, the board-side shell 32 has board-side contacting structures 33. The board-side contacting structures 33 project into an interior space in the fourth molding 27 when the board-side shell 32 is mounted on the fourth molding 27. The board-side connecting structures 33 (in this case, the structure may be formed into something like an elastic body) are brought into contact with the cable-side contacting structures 17 corresponding thereto when the harness connector 1 is connected to the board-side connector 26. Thus, the board-side contacting structures 33 are a conducting means for grounding.

In this case, either of the board-side contacting structures or the cable-side contacting structures may be formed into something like an elastic body, whereby when both are connected to each other, it is needless to say that better conductivity can be secured.

The board-side contacts 44 are made from a copper alloy for springs and is a round pin having a circular cross-section. However, it is possible to adopt an angular pin having a square cross-section. These board-side contacts are press fitted in inserting holes (not shown) formed in the fourth molding 27.

Figure 6:
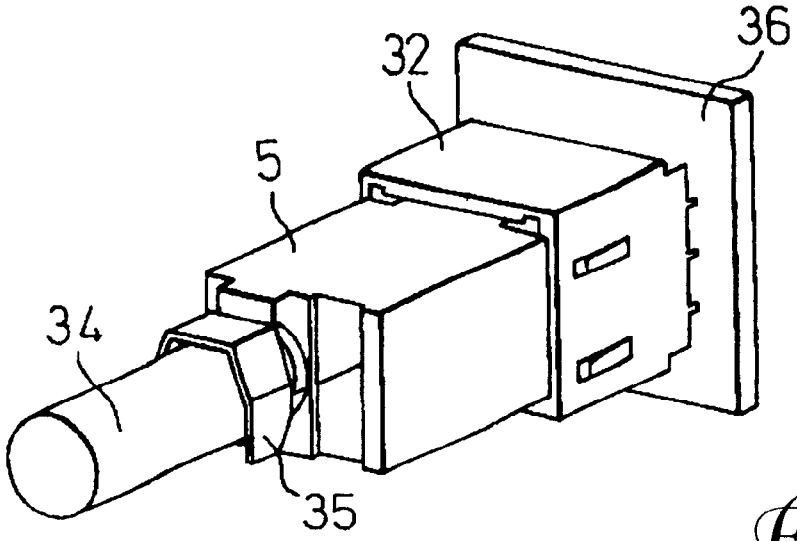
FIG. 6 is a drawing illustrating a grounding mechanism of the present invention.

Next, referring to FIG. 6, the grounding mechanism according to the invention will be described. While FIG. 6 shows the harness connector 1 as being connected to the board-side connector 26, for the sake of easily understanding the grounding mechanism according to the invention, the respective moldings and the latch mechanism are omitted.

In this embodiment, a jacket shield of the electric cable 34 is caused to contact with the board-side shell 32 via the cable clamping portion 35. The cable-side shell 5 is caused to contact with the board-side shell 32 via the cable-side contacting structures 17 and the board-side contacting structures 33. Then, the board-side shell 32 is caused to contact with the printed board 36 via the pins 28 thereof. Thus, the jacket shield, the cable-side shell, the board-side shell and the printed board are conducted in that order for establishment of grounding.

Thus, the connector system according to the present invention comprises the shielding shells which are complementary to each other.

Figure 7:
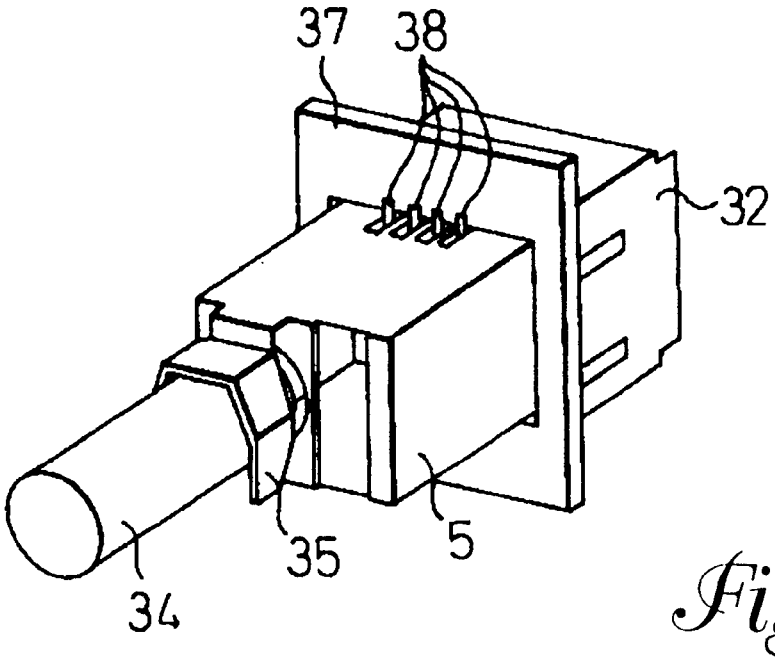
FIG. 7 is a drawing illustrating another grounding mechanism of the present invention.

Moreover, a grounding mechanism different from the aforesaid grounding mechanism may be adopted. For example, as shown in FIG. 7, a shield plate 37 is mounted on the board-side connector 26, and grounding springs 38 are formed on a wall surface of the cable-side shell, whereby the grounding springs 38 may be brought into contact with the shield plate 37 when the harness connector 1 is coupled to the board-side connector 26. Here, the jacket shield, the cable-side shell and the shield plate are grounded in that order.

Figure 8:
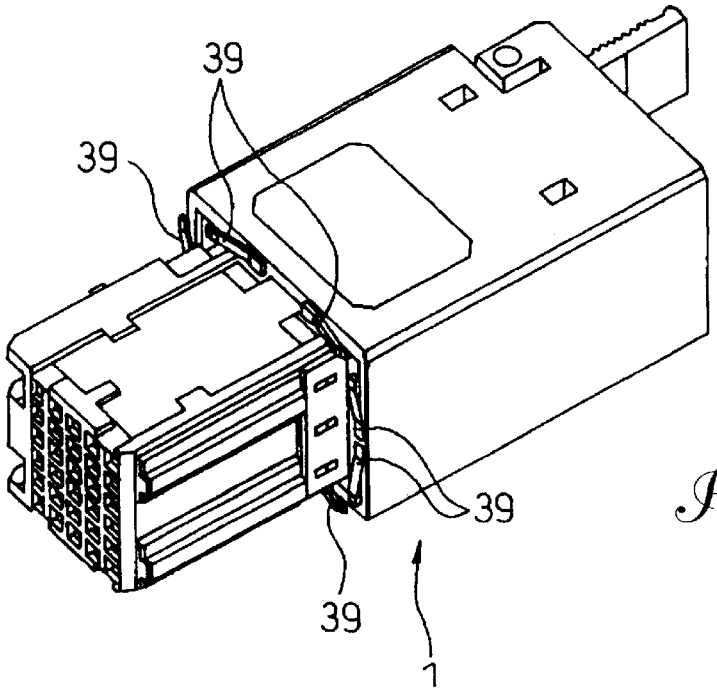
FIG. 8 is a perspective view showing a harness connector having another contacting structure according to the present invention.

Furthermore, a grounding spring of a different type from the aforesaid grounding springs may be adopted. For example, as shown in FIG. 8, grounding springs 39 may be adopted which are formed so as to be located along the circumference of a front side of the fourth molding 6.

Figure 9:
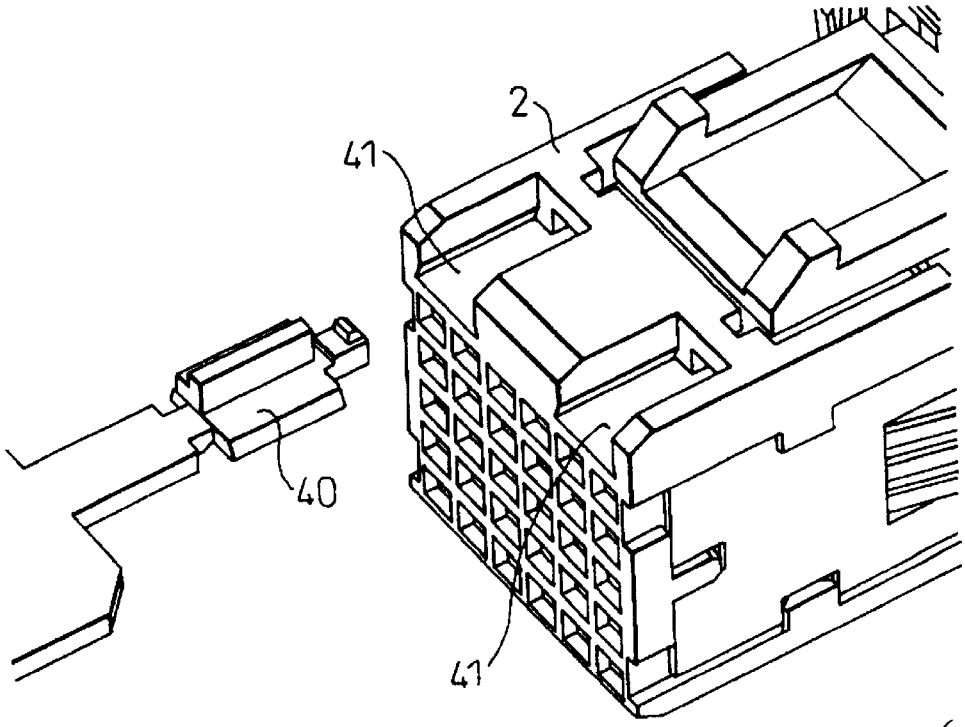
FIG. 9 is a perspective view showing a polarized key for mounting on the harness connector.
Figure 10:
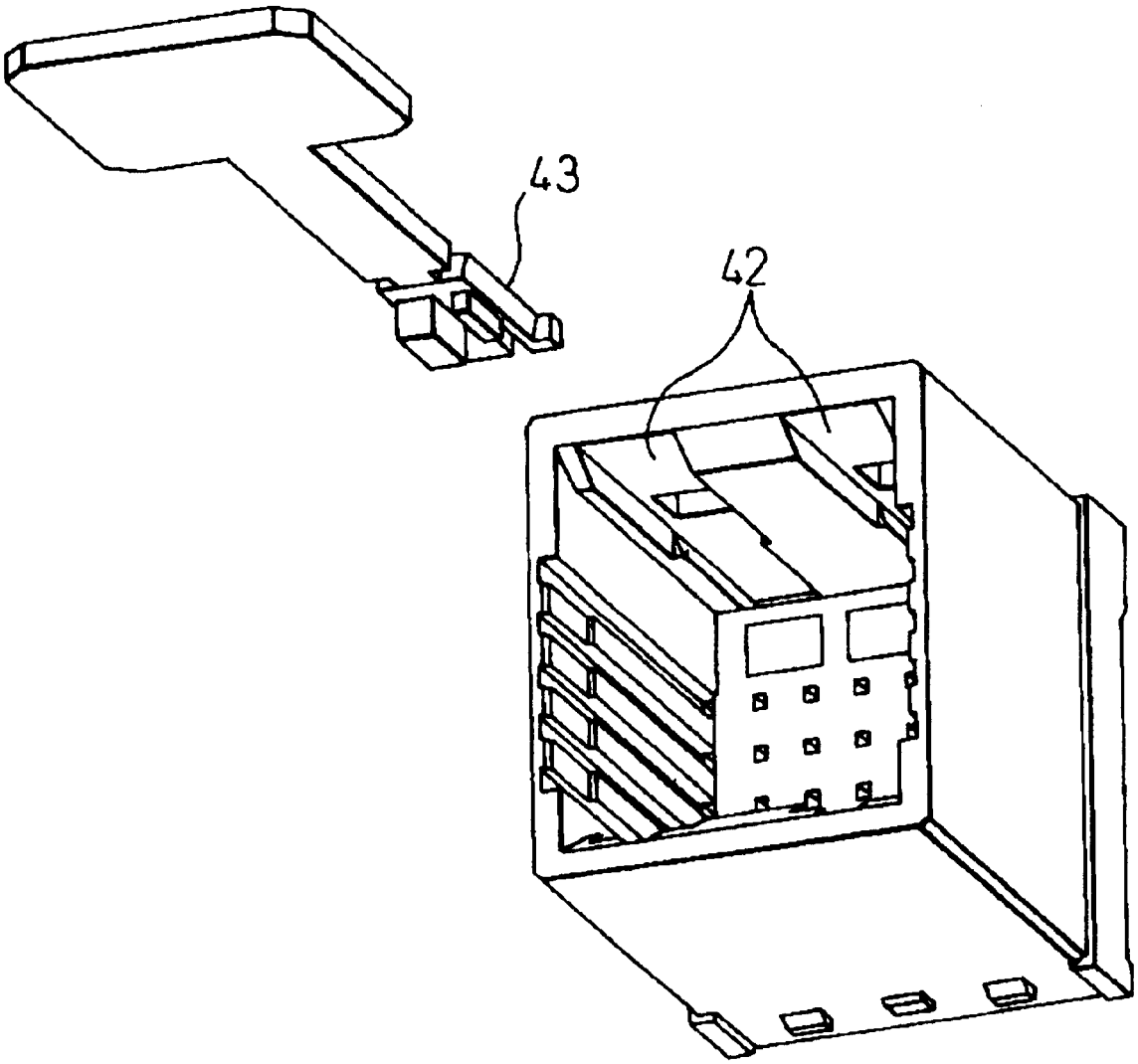
FIG. 10 is a perspective view showing a polarized key for mounting on the board-side connector.

In addition, a system for preventing the erroneous insertion of the harness connector into the board-side connector of the embodiment may be adopted which is different from the system comprising the guide grooves/guide projections. For example, an erroneous insertion preventing system (a key polar system) may be adopted which constituted by polarized keys 40 adapted to be inserted into grooves 41 formed instead of the guide grooves 9 which are formed in the first molding 2 as shown in FIG. 9 and a polarized key 43 adapted to be inserted into a groove 42 formed instead of the guide projections 29 formed in the fourth molding 27.

According to the present invention, the board-side connector and the harness connector are releasably fixed to each other with the latch means housed within the outermost profile of both the connectors. In other words, the connector system can be constructed such that both the connectors can be releasably fixed to each other without necessity of enlarging the connector system.

What is claimed is:

1. A connector system having contacts arranged in rows and lines, wherein the system is constituted by a board-side connector adapted to be connected to a printed board and a harness connector adapted to be connected to an electric cable, and comprising latch means for releasably fixing the board-side connector and the harness connector to each other, the latch means being installed within the outermost profile of both the connectors, wherein the harness connector is constituted by assembling sequentially from an interior side to an exterior side thereof a first insulated resin molding into which the contacts are inserted, a second insulated resin molding on which a latch arm of the latch means is mounted, a metal shell for electromagnetic shielding and a third insulated resin molding for protection against static electricity.

2. A connector system as set forth in claim 1, wherein the board-side connector comprises a shield shell which is complementary to the metal shell of the harness connector.

3. A connector system as set forth in claim 1, wherein the board-side connector is of a modular type and has a shielding plate, the harness connector metal shell has a resilient contacting structure, and the contacting structure is adapted to be brought into contact with the shielding plate when the harness connector is connected to the board-side connector.

4. A connector system as set forth in claim 1, wherein the latch means is adapted to operate only within the outermost profile of both connectors.

5. A connector system as set forth in claim 1, wherein the system comprises polarized keys for preventing an erroneous connection between the harness connector and the board-side connector.

6. A connector system as set forth in claim 1, wherein the board-side connector is of a module type and has a board-side metal shell which has a pin or pins for grounding the printed board on at least one of outer sides of the board-side connector.

7. A connector system as set forth in claim 6, wherein the harness connector metal shell and the board-side metal shell each comprises a complementary contacting structure and these complementary contacting structures are brought into contact with each other when the harness connector is connected to the board-side connector.

* * * * *